United States Patent [19]

Arrey et al.

[11] Patent Number: 4,644,871

[45] Date of Patent: Feb. 24, 1987

[54] ARTICULATED HOPPER RAILCAR

[75] Inventors: Kelly J. Arrey; Samir Berrada, both of Montreal, Canada

[73] Assignee: Canadian National Railway Company, Montreal, Canada

[21] Appl. No.: 807,610

[22] Filed: Dec. 11, 1985

[51] Int. Cl.[4] ..... B61D 3/14; B61D 7/02

[52] U.S. Cl. ..... 105/4.1; 105/248

[58] Field of Search ..... 105/3, 4 R, 4 A, 247–253; 280/408

[56] References Cited

U.S. PATENT DOCUMENTS

| | | | |
|---|---|---|---|
| 1,657,579 | 1/1928 | McCullough | 105/4 R |
| 2,079,862 | 5/1937 | Kiesel, Jr. | 105/247 X |
| 2,508,339 | 5/1950 | Schroeder et al. | 105/4 R |
| 2,954,745 | 10/1960 | Lich | 105/4 R |
| 3,002,470 | 10/1961 | Flowers | 105/4 R X |
| 3,133,508 | 5/1964 | Sensenich | 105/4 R |
| 3,557,708 | 1/1971 | Bolte | 105/4 R |
| 3,584,564 | 6/1971 | Rollins | 105/247 X |
| 3,678,863 | 7/1972 | Pringle | 105/4 R |
| 3,678,864 | 7/1972 | Gutridge | 105/4 R |
| 3,687,084 | 8/1972 | O'Leary et al. | 105/4 R |
| 3,716,146 | 2/1973 | Altherr | 213/75 R |
| 3,807,317 | 4/1974 | Stark | 105/4 R X |
| 3,896,945 | 7/1975 | Bjorklund et al. | 105/4 R X |
| 4,315,465 | 2/1982 | Cordani et al. | 105/4 R |
| 4,454,821 | 6/1984 | Dickhart, III | 105/4 R |
| 4,456,413 | 6/1984 | Pavlick | 105/4 R X |
| 4,503,779 | 3/1985 | Chadwick | 105/4 R |

*Primary Examiner*—Robert B. Reeves

*Assistant Examiner*—David F. Hubbuch

*Attorney, Agent, or Firm*—Larson and Taylor

[57] ABSTRACT

An articulated hopper railcar is provided which when fully loaded has a low combined center of gravity and has an improved track load distribution when compared with conventional railcars of similar capacity. The car has good dynamic stability making it ideal for rail lines with greater surface irregularities and sharper curves than those found on main lines. The car includes two hopper car bodies, each car body having an adjacent end and an exterior end, each car body having a hopper therein with at least one discharge exit, the hopper having a first end sheet at the exterior end of the car body, sloped upwards and outwards from the hopper, and a second end sheet at the adjacent end of the car body, sloped upwards and inwards towards the hopper; two end trucks with wheels, each end truck supporting the exterior end of each car body; a pin connection mounted on each end truck for pivotally supporting the exterior end of the car body on the end truck; center truck with wheels for supporting the adjacent ends of the two car bodies; articulated connector mounted on the center truck for connecting the adjacent ends of the two car bodies together and for pivotally supporting the adjacent ends of the two car bodies on the center truck; end coupler at the exterior end of each car body adapted for coupling the hopper railcar to an adjacent railcar or locomotive, and center sill member in each car body extending in line through the hopper from the end coupler to the articulated connector, adapted to transfer traction load through the hopper railcar.

7 Claims, 5 Drawing Figures

ARTICULATED HOPPER RAILCAR

The present invention relates to an articulated hopper railcar which when fully loaded has a low combined center of gravity and an improved track load distribution compared with conventional railcars of similar capacity.

Many branch railway lines are load restricted and have surface irregularities that are more severe than those found on main lines. In some cases box cars or hopper cars used on these branch lines for the shipment of grain and other particulate material are used with reduced capacity loading which is inefficient use of the railcars.

It is a purpose of the present invention to provide a hopper railcar which when fully loaded has a low combined center of gravity, thus having good dynamic stability so that the railcar is ideal for rail lines with surface irregularities more severe than found on main lines. Furthermore, it is another purpose of the present invention to provide an articulated hopper railcar which has an improved track load distribution compared with conventional railcars of similar capacity, thus subjecting the rail and track to lower stresses which decreases track maintenance costs.

It is a still further purpose to provide a railcar which compares favourably with other types of railcars in terms of load capacity per linear foot and net load capacity per unit car weight so the railcar may be used competitively throughout all sessions of the year.

The present invention provides an articulated hopper railcar which when fully loaded has a low combined center of gravity and an articulated connection with a relatively short distance between truck centers. The railcar features two bodies supported by a center truck and two end trucks. The center truck takes somewhat more loading than the other two end trucks, but the arrangement of axle spacing is less severe on track loading than conventional hopper railcars.

The present invention provides an articulated hopper railcar comprising two hopper car bodies, each car body having an adjacent end and an exterior end, each car body having a hopper therein with at least one discharge means, the hopper having a substantially vertical end sheet at the exterior end of the car body joined to an exterior slope sheet sloping down to the discharge means, and an inward sloping end sheet at the adjacent end of the car body joined to an adjacent slope sheet sloping down to the discharge means; two end trucks with wheels, each end truck supporting the exterior end of each car body; end support means mounted on each end truck for pivotally supporting the exterior end of the car body on the end truck; center truck with wheels for supporting the adjacent ends of the two car bodies; articulated connector means mounted on the center truck for connecting the adjacent ends of the two car bodies together and for pivotally supporting the adjacent ends of the two car bodies on the center truck; end coupling means at the exterior end of each car body adapted for coupling the hopper railcar to an adjacent railcar or locomotive, and center sill member in each car body extending in line through the hopper from the end coupling means to the articulated connector means, adapted to transfer traction load through the hopper railcar.

In other embodiments of the invention, the discharge means from the hopper is located below the center sill member. The discharge means preferably includes at least two separate discharge exits for each of the car bodies, the exits located between the end trucks and the center truck, the exterior slope sheet sloping down to one exit, and the adjacent slope sheet sloping down to the other exit. In one embodiment, the exterior slope sheet slopes down to a vertical step at one side of the discharge exit. In one embodiment, shape and position of end, side and slope sheets forming the hoppers in the hopper car bodies are arranged to distribute weight of the loaded hopper car such that the end trucks have a rated capacity of 50 tons each and the center truck has a rated capacity of 70 tons. In one embodiment, the load capacity of the hopper railcar is 108 tons and the distance between the center truck center and the end truck center is 25½ feet. In one embodiment, the center of gravity of a loaded hopper railcar is approximately 84 inches above top of rail.

In drawings which illustrate embodiments of the present invention;

Figure 1:
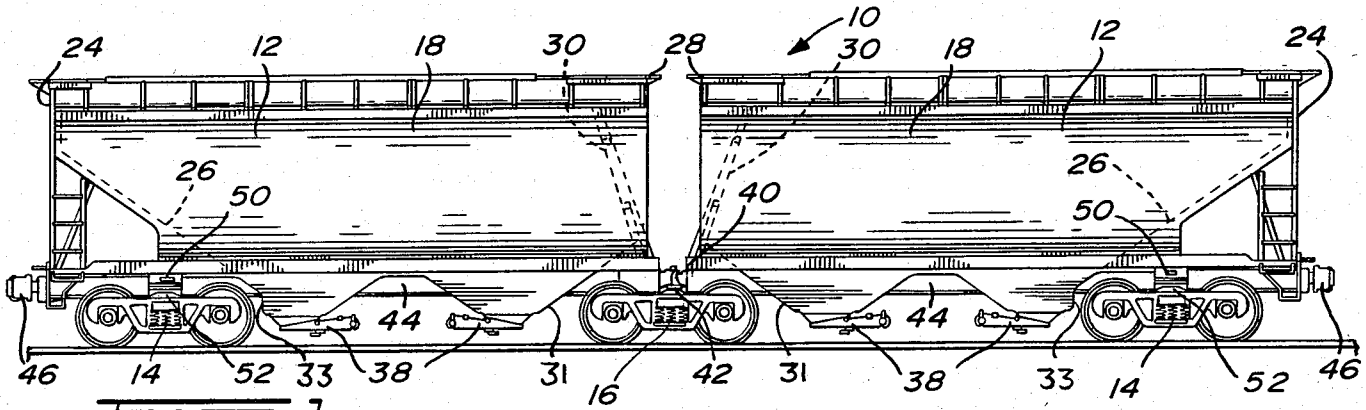
FIG. 1 shows a side view of an articulated hopper railcar according to one embodiment of the present invention.
Figure 2:
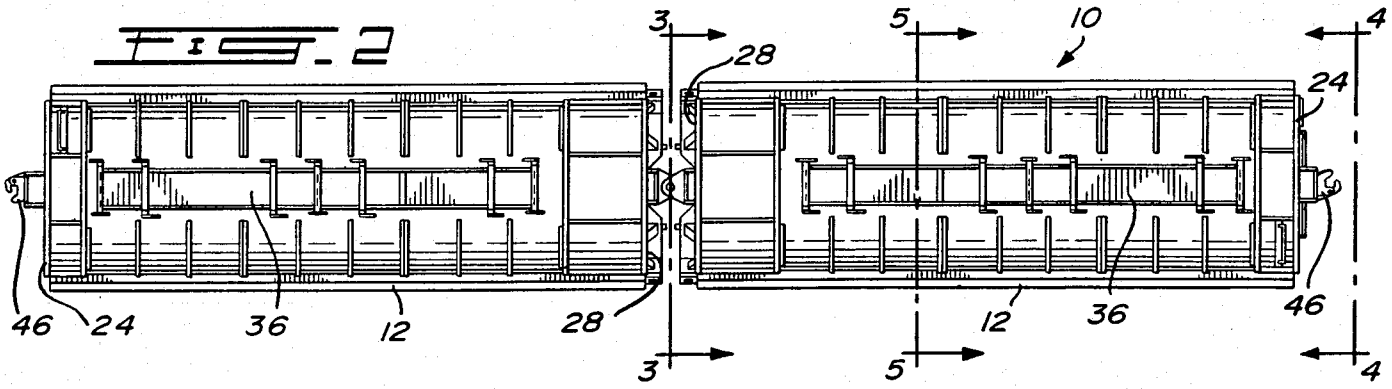
FIG. 2 shows a top plan view of the railcar shown in FIG. 1.

Referring now to the drawings, the articulated hopper railcar 10 has two car bodies 12 positioned side by side, supported on two truck ends 14 and a center truck 16. Each hopper car body 12 has a hopper 18 with curved side sheets 20, and a curved roof sheet 22. A vertical exterior end 24 positioned over the end truck 14 is joined to a sloped end sheet 26 which slopes down to the exit, and an adjacent end 28 of the hopper 18 positioned over the center truck 16 has an inward sloping end sheet 30 which joins to an adjacent slope sheet 31 sloping down to the exit. In the embodiment shown a vertical step 33 or dog leg is provided at the bottom of the exterior slope sheet 26. The step 33 raises the end of the slope sheet so the weight distribution in the hopper is moved towards the center truck 16, thus the weight distribution on the truck is more evenly divided. The two ends of the hoppers 18 are different and this is designed to spread the weight of the contents of the two hoppers 18 such that each truck is used to its rated capacity.

Platforms 32 are provided on top of the hoppers 18 for operation and maintenance purposes. Access ladders 34 are positioned at each end of the articulated car for access to platforms 32. Hatches 36 are located in the top of each of the hoppers 18 for loading and two hopper discharge exits 38 are provided at the bottom of each hopper 18. The discharge exits 38 are located between the center truck 16 and end trucks 14.

Figure 5:
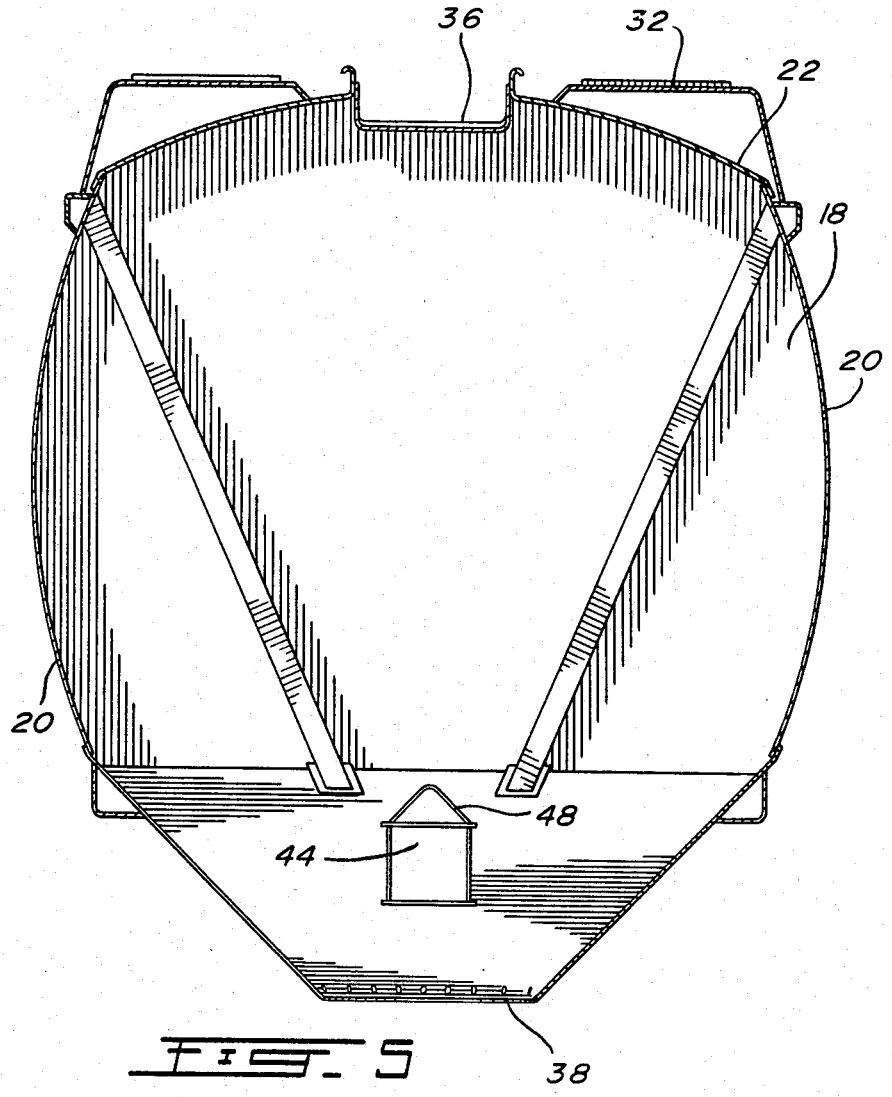
FIG. 5 shows a cross sectional view taken at line 5—5 of FIG. 2.

The adjacent ends 28 of the hopper car bodies 12 are joined together at an articulated connector 40 supported on a bolster 42 formed integral with the center truck 16. The articulated connector 40 while not detailed herein, may be of the type which includes conventional male and female connector elements connected to the same center pin. One type of coupler suitable for use in the present invention is that type manufactured by American Steel Foundries as shown in U.S. Pat. No. 3,716,146. A center sill 44, shown in FIG. 5 has a rectangular cross section formed of welded steel plate and extends throughout both hopper car bodies 12. The center sill 44 is in line with and connects directly to the articulated connector 40, and at the two exterior ends of the railcar connects to a standard coupling device 46 so that the traction load is transferred directly from the coupling 46 at one end, through the center sills 44, and the articulated connector 40 to the coupling 46 at the other end. As illustrated in FIG. 5, an inverted V cap 48 fits over the center sill 44 in the hopper body 18 so that grain or other material within the hopper flows past the sill 44 during discharge.

Figure 3:
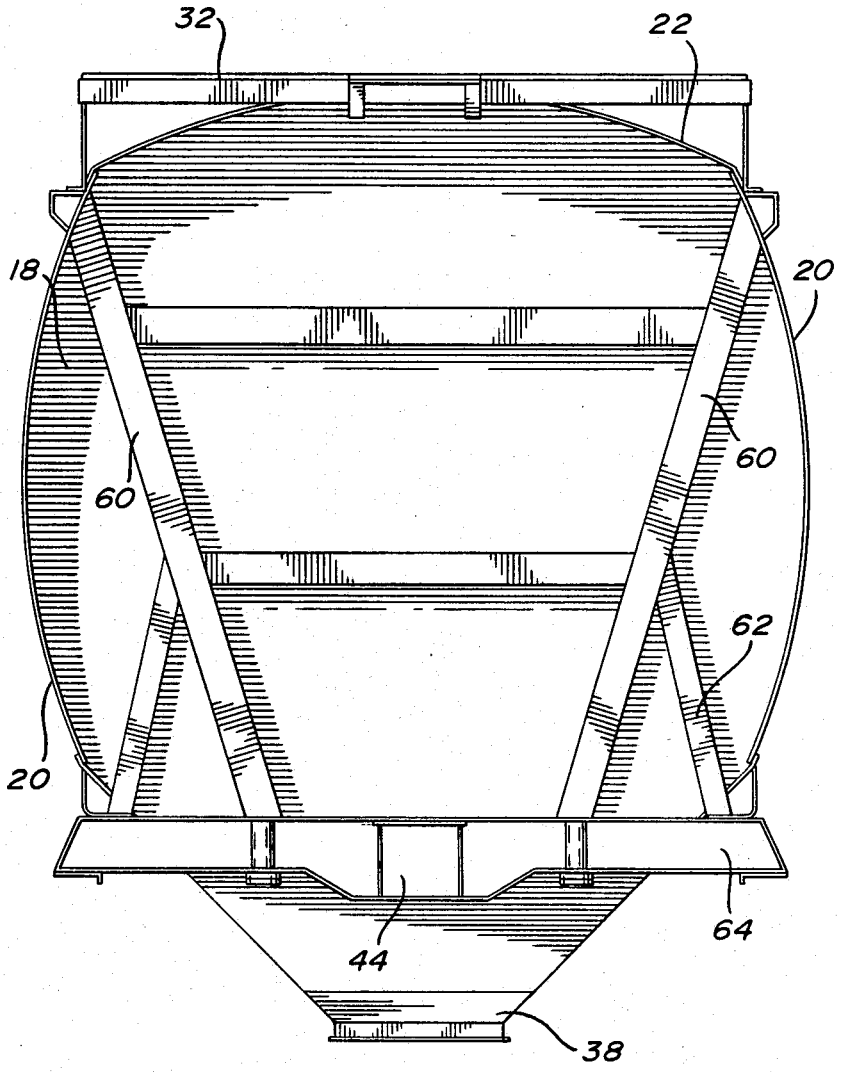
FIG. 3 shows a sectional view taken at line 3—3 of FIG. 2.
Figure 4:
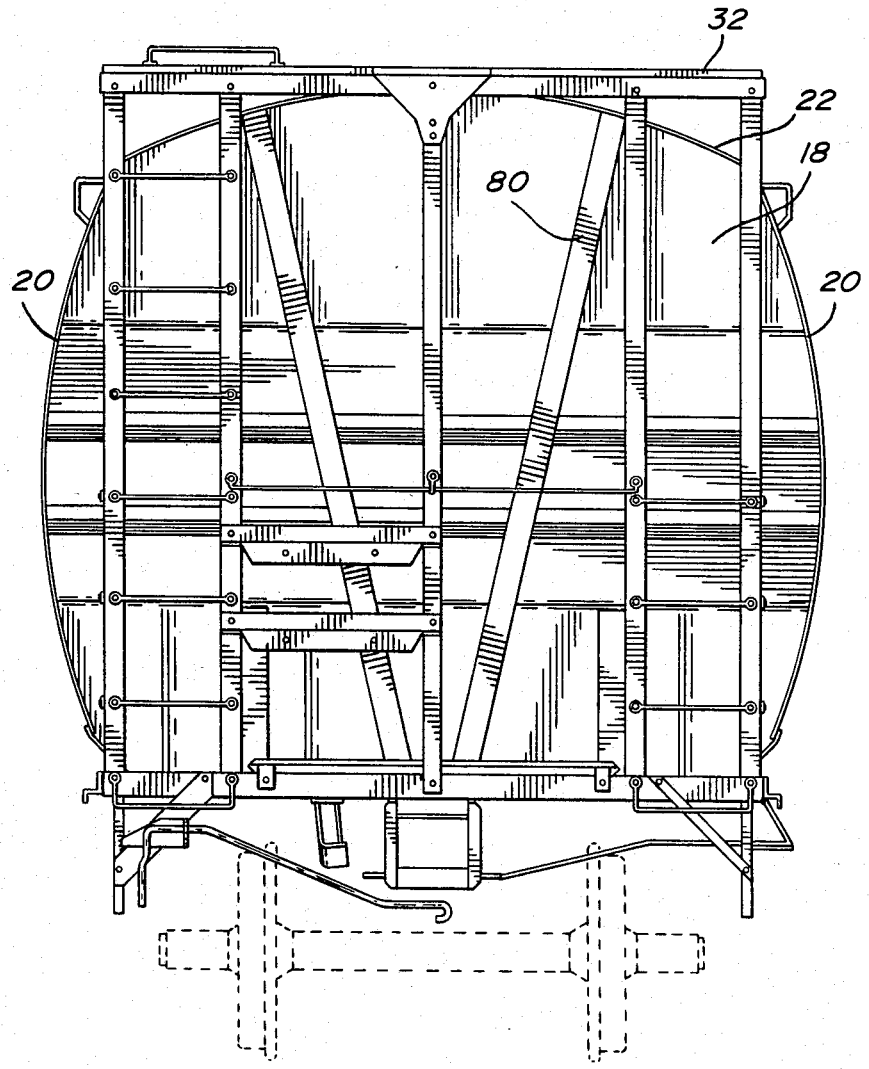
FIG. 4 shows an end view taken at line 4—4 of FIG. 2.

The exterior ends 24 of each hopper car body 12 has a pin connection 50 supported on a bolster 52 formed integral with the end truck 14. As can be seen in FIG. 1, the discharge hoppers 38 are located below the center sill 44 and the center of gravity of the full hopper 18 is positioned as short a distance as possible from the top of the rail. Materials of construction are high tensile steel with welded frame. As shown in FIG. 3, main stiffners 60 are provided at the adjacent ends to transfer loads from the hopper car body 12 to the center sill 44 and center truck 16. Secondary stiffners 62 are connected from the main stiffners 60 to end sills 64 to help sustain jacking loads. This arrangement of stiffners allows for a higher construction of end sill 64. The end sills 64 are provided at the adjacent ends of each car body 12 in order to sustain side bearing and jacking loads. The end sills 64 are "wing-shaped" to clear the center truck 16 and to reduce the length of the side bearing supports.

Reinforcement posts 80 are used at the exterior ends 24 of each hopper car body 12. These posts 80 allow the center sill 44 and the hopper car body 12 to work jointly in sustaining coupler loads and vertical lading loads.

In one embodiment the center truck 16 has a rated capacity of 70 tons and the two end trucks 14 have rated capacities of 50 tons each. The capacity of the hopper railcar, that is to say, the two hoppers 18 when filled with grain having a density of 46.7 lbs. per cu. ft. comes to 108 tons of grain. This gives an actual rail load of 55 tons on the center truck, and 44 tons on each end truck. Distance between truck centers is 25½ feet and the coupled length of the articulated railcar is 66½ feet. The gross rail load of the loaded railcar is 143 tons with a tare weight of 35 tons. Volume of the hoppers is 4750 cu. ft. The center of gravity of the loaded hopper railcar is approximately 84 inches above the top of the rail.

The low center of gravity, the articulated connection and the relatively short distance between the truck centers, all help to provide good dynamic stability and make this railcar ideal for rail lines with greater surface irregularities and sharper curves than those found on main lines. Furthermore, the better track load distribution subjects the rail and track to lower stresses.

Various changes may be made to the embodiments described herein without departing from the scope of the present invention which is limited only by the following claims.

The embodiments of the invention in which an exclusive property or privilege is claimed are defined as follows.

1. An articulated hopper railcar comprising:

two hopper car bodies, each car body having an adjacent end and an exterior end, each car body having a hopper therein with at least one discharge means, the hopper having a substantially vertical end sheet at the exterior end of the car body joined to an exterior slope sheet sloping down to the discharge means and an inward sloping end sheet at the adjacent end of the car body sloping downwardly toward the adjacent car body joined to an adjacent slope sheet sloping down to the discharge means;

two end trucks with wheels, each end truck supporting the exterior end of each car body;

end support means mounted on each end truck for pivotally supporting the exterior end of the car body on the end truck;

center truck with wheels for supporting the adjacent ends of the two car bodies;

articulated connector means mounted on the center truck for connecting the adjacent ends of the two car bodies together and for pivotally supporting the adjacent ends of the two car bodies on the center truck;

end coupling means at the exterior end of each car body adapted for coupling the hopper railcar to an adjacent railcar or locomotive, and center sill member in each car body extending in line through the hopper from the end coupling means to the articulated connector means, adapted to transfer traction load through the hopper railcar.

2. The hopper railcar according to claim 1 wherein the discharge means from the hopper is located below the center sill member.

3. The hopper railcar according to claim 1 wherein the discharge means includes at least two separate discharge exits for each of the car bodies, the exits located between the end trucks and the center truck, the exterior slope sheet sloping down to one exit, and the adjacent slope sheet sloping down to the other exit.

4. The hopper railcar according to claim 1 wherein the exterior slope sheet slopes down to a vertical step at one side of the discharge exit.

5. The hopper railcar according to claim 1 wherein shape and position of end, side and slope sheets forming the hoppers in the hopper car bodies are arranged to distribute weight of the loaded hopper car such that the end trucks have a rated capacity of 50 tons each and the center truck has a rated capacity of 70 tons.

6. The hopper railcar according to claim 5 wherein the loaded capacity of the hopper railcar is 108 tons and the distance between the center truck center and the end truck centers is 25½ feet.

7. The hopper railcar according to claim 6 wherein the center of gravity of the loaded hopper railcar is approximately 84 inches above top of rail.

* * * * *